US006366246B1

(12) United States Patent
Nagaike et al.

(10) Patent No.: US 6,366,246 B1
(45) Date of Patent: Apr. 2, 2002

(54) ANTENNA HOLDING DEVICE AND METHOD FOR MOUNTING ANTENNA

(75) Inventors: Syotaro Nagaike; Yoji Inomata, both of Kanagawa (JP)

(73) Assignee: Matshushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/410,725

(22) Filed: Oct. 1, 1999

(30) Foreign Application Priority Data

Oct. 6, 1998 (JP) ..... 10-297567

(51) Int. Cl.[7] ..... H01Q 1/24
(52) U.S. Cl. ..... 343/702; 343/906; 439/916
(58) Field of Search ..... 248/224.8, 223.41, 248/220.21, 220.31, 535, 519; 343/702, 878, 888, 715, 900, 906; 439/916; H01Q 1/24

(56) References Cited

U.S. PATENT DOCUMENTS 4,611,213 A * 9/1986 Johnson et al. ..... 343/702
5,551,080 A * 8/1996 Chambers et al. ..... 343/702
5,659,889 A * 8/1997 Cockson ..... 343/702
5,835,071 A * 11/1998 Phelps ..... 343/702

* cited by examiner

*Primary Examiner*—Michael C. Wimer
(74) *Attorney, Agent, or Firm*—Pearne & Gordon LLP

(57) ABSTRACT

The invention is to provide an antenna holding device, capable of achieving easy assembly and enlarging freedom in the assembling process. An antenna can be held by a screw so as to be mounted onto an antenna holder. The antenna holder is mounted onto a main body case by the outserting mount method. The main body case is provided with a groove, capable of holding an antenna terminal by itself. According to the configuration, freedom in the order of assembling process can be enlarged, and the process can be divided into smaller steps. Furthermore, operativity in assembly can be improved.

2 Claims, 4 Drawing Sheets

ANTENNA HOLDING DEVICE AND METHOD FOR MOUNTING ANTENNA

BACKGROUND OF THE INVENTION

The present invention relates to an antenna holding device to be used in communication equipment, such as portable phones, and a method for mounting an antenna, and in particular relates to one capable of allowing easy assembly and enlarging the degree of freedom in the assembling process.

An antenna holding device used conventionally in communication equipment, such as portable phones and PHS, holds an antenna 11 by mounting an antenna holder 12 with an antenna terminal 13 mounted from the inside and the antenna 11 from the outside at the same time to a main body case 14 as shown in FIGS. 4 and 5.

However, in order to hold the antenna terminal 13 and the antenna 11 on the main body case 14 in the conventional antenna holding device, the antenna terminal 13 needs to be mounted on the antenna holder 12, and the antenna holder 12 and the antenna 11 need to be mounted onto the main body case 14 at the same time.

Therefore, problems are involved in that skill is required in assembly and that the complicated configuration gives rise to cost increase.

SUMMARY OF THE INVENTION

Accordingly, an object of the present invention is to provide an antenna holding device capable of solving the conventional problems, to be assembled easily with a larger degree of freedom in assembling process with a simple configuration at a low cost, and a method for mounting an antenna.

In order to achieve the above-mentioned object, an antenna holding device according to the invention has a configuration wherein an antenna holder is mounted onto a main body case, with the main body case provided with a groove for holding an antenna terminal by itself, and the antenna holder can hold an antenna by means of a screw.

Furthermore, a method for mounting an antenna according to the invention comprises a step of mounting an antenna holder onto a main body case, a step of mounting an antenna terminal onto the main body case to be held by itself, and a step of mounting an antenna onto the antenna holder.

Accordingly, an antenna holding device capable of achieving easy assembly and a larger degree of freedom in the assembling process with a simple configuration at a low cost, and a method for mounting an antenna can be provided.

A first aspect of the invention is an antenna holding device comprising an antenna having a mounting portion, an antenna holder for holding the antenna, an antenna terminal to be held by itself by a main body case described later, and the main body case to be mounted with the antenna holder, for holding the antenna terminal so as to achieve the effect of allowing easy assembly and enlarge the degree of freedom in the assembling process.

A second aspect of the invention is the antenna holding device according to the first aspect, wherein a groove is provided in the main body case for holding the antenna terminal by itself so as to achieve the effect of allowing easy assembly and enlarge the degree of freedom in the assembling process.

A third aspect of the invention is a method for mounting an antenna comprising a step of mounting an antenna holder onto a main body case, a step of mounting an antenna terminal onto the main body case so as to be held by itself, and a step of mounting an antenna onto the antenna holder so as to achieve the effect of facilitating the antenna assembly.

A fourth aspect of the invention is the method for mounting an antenna according to the third aspect, wherein the outserting mount method or the inserting mount method is adopted in the step of mounting the antenna holder onto the main body case so as to achieve the effect of facilitating the antenna assembly.

DETAILED DESCRIPTION OF THE PREFERRED EMBODIMENTS

Figure 1:
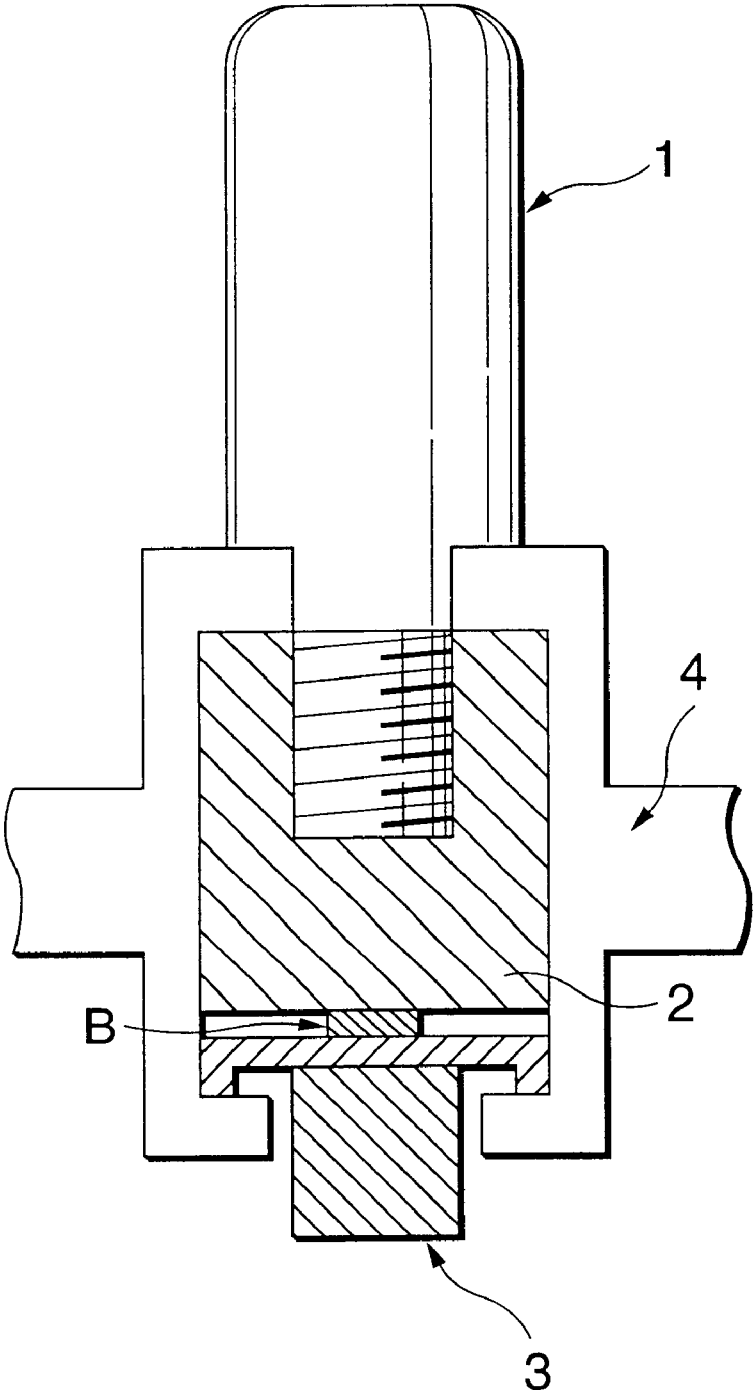
FIG. 1 is a cross-sectional view showing the configuration of an embodiment of an antenna holding device according to the invention.
Figure 2:
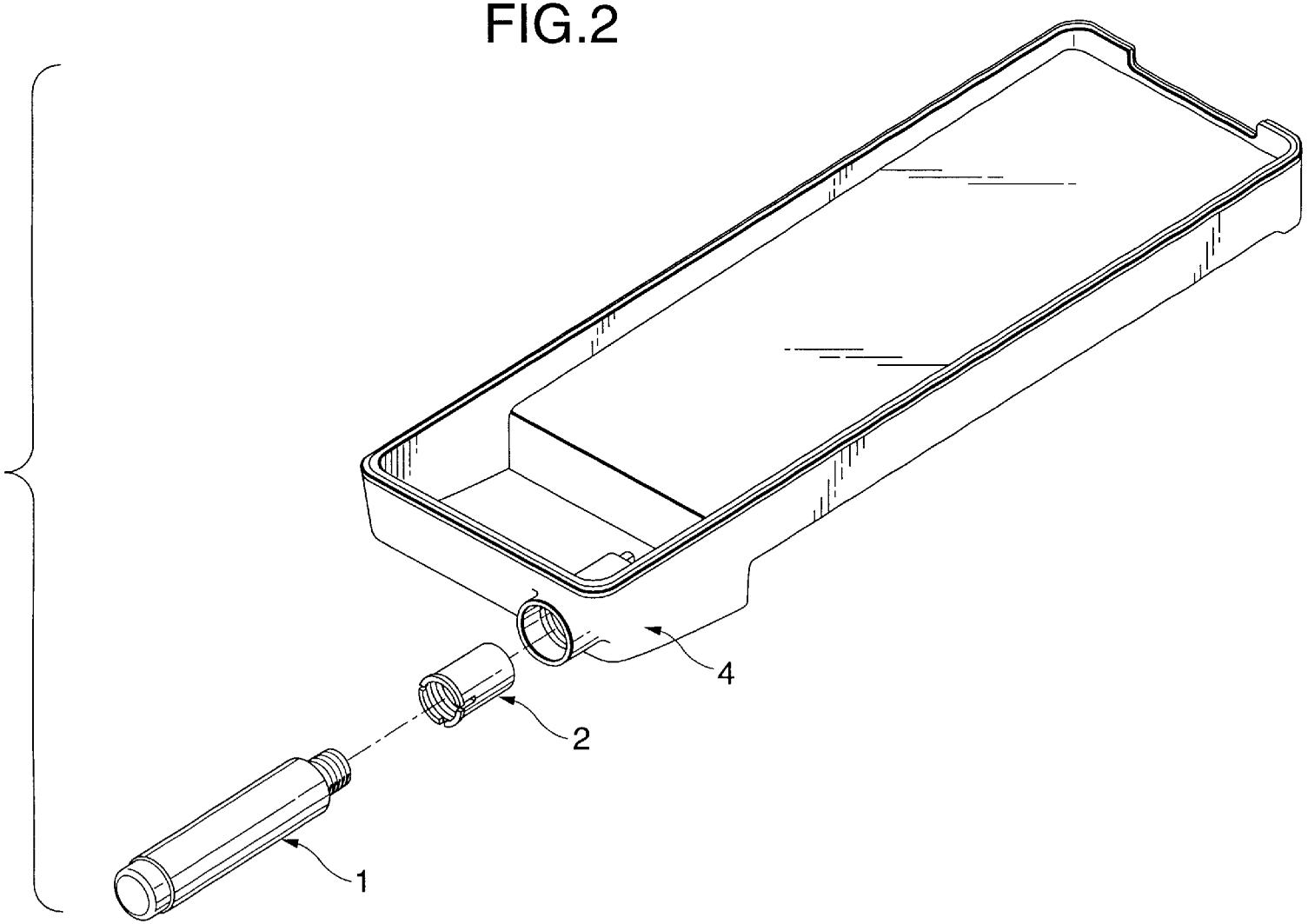
FIG. 2 is an exploded perspective view showing the state of mounting an antenna holder comprising the embodiment of the antenna holding device of the invention into an main body case and mounting an antenna into the antenna holder.
Figure 3:
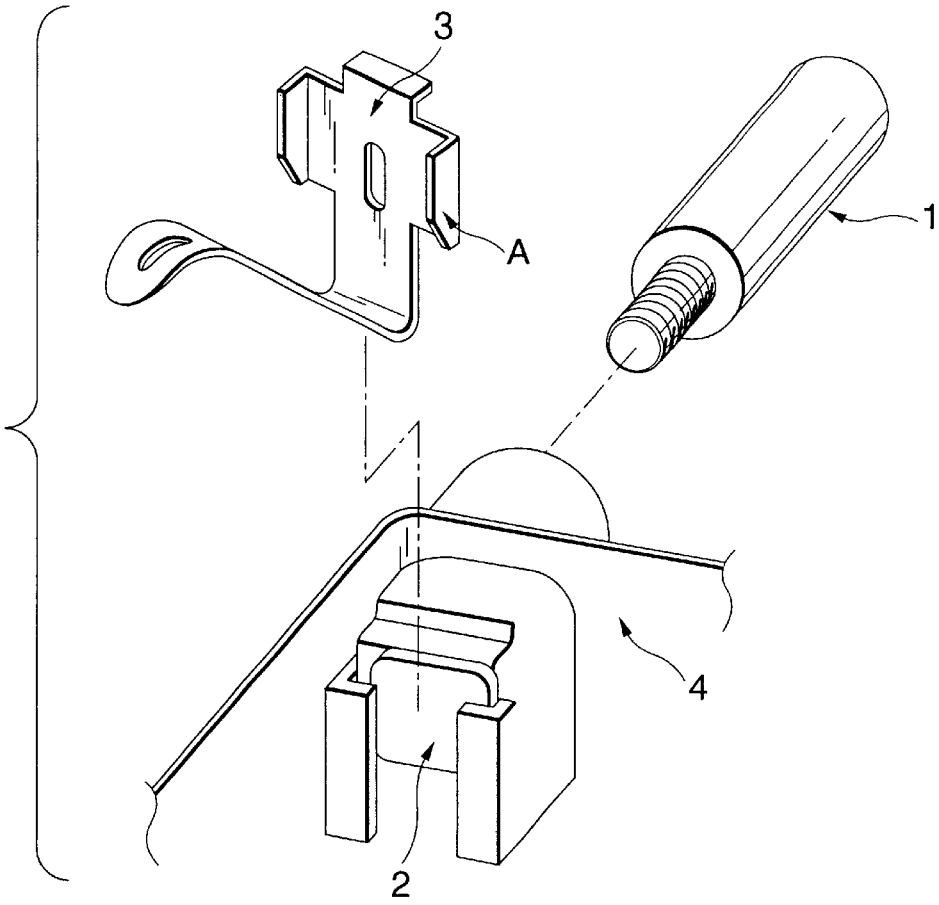
FIG. 3 is an exploded perspective view showing the state of mounting an antenna terminal comprising the embodiment of the antenna holding device of the invention into the main body case and mounting the antenna into the antenna holder.
Figure 4:
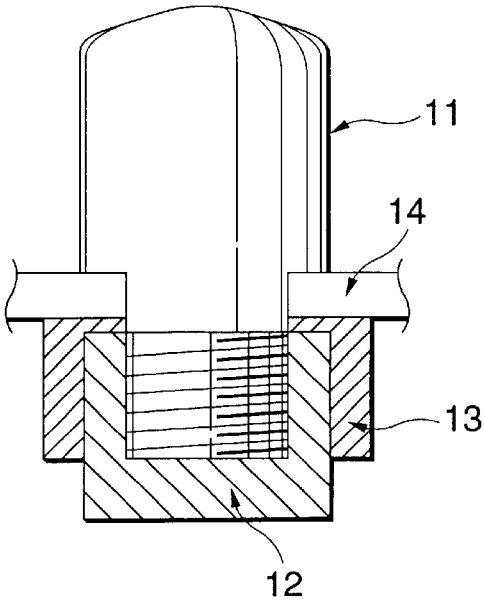
FIG. 4 is a cross-sectional view showing the configuration of a conventional antenna holding device.
Figure 5:
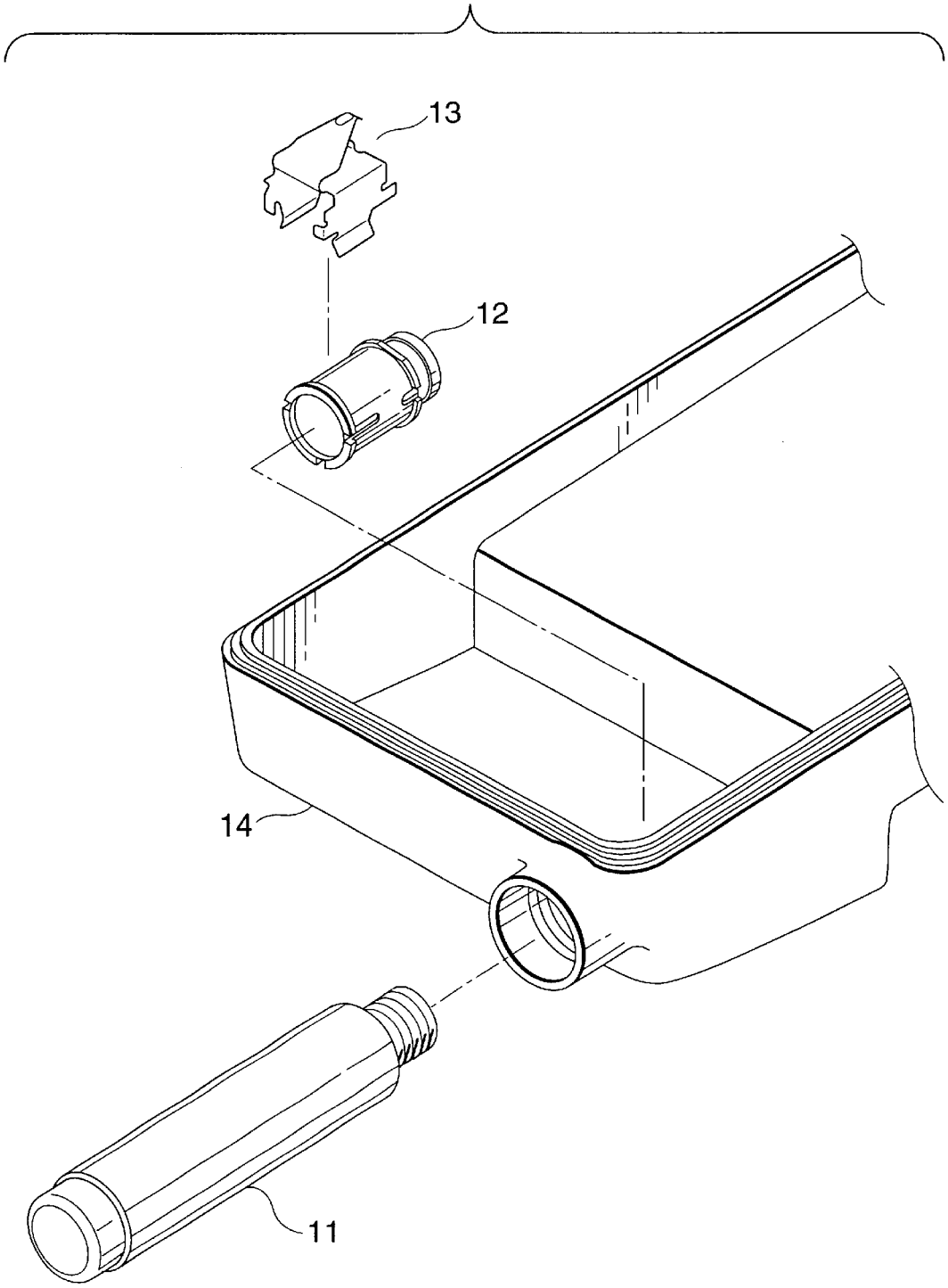
FIG. 5 is an exploded perspective view showing the state of assembling into a main body case in the conventional antenna holding device.

Hereinafter an embodiment of the invention will be explained with reference to FIGS. 1 to 3. FIG. 1 is a cross-sectional view of an embodiment of an antenna holding device according to the invention in the assembled state. FIG. 2 is an exploded perspective view showing the state of mounting the antenna holder onto the main body case and mounting the antenna onto the antenna holder. FIG. 3 is an exploded perspective view showing the state of mounting the antenna terminal comprising the embodiment of the antenna holding device according to the invention onto the main body case and mounting the antenna onto the antenna holder.

In FIGS. 1 to 3, the antenna 1 has a configuration to be held with a screw so as to be mounted onto the antenna holder 2. As shown in FIG. 2, the antenna holder 2 is mounted onto the main body case 4 by the outserting mount method. The antenna holder is mounted to the main body case 4 after molding of the main body case. The resin of the main body case 4 is welded by the ultrasonic to fix the antenna holder. Alternatively, in this case, it can be mounted onto the main body case 4 by the inserting mount method (in that the antenna holder is mounted together with molding of the main body case) as another choice. The main body case 4 is provided with a groove, capable of holding the antenna terminal 3 by itself.

Further, as shown in FIGS. 1 and 3, the antenna terminal 3 has a bent portion A having a size substantially the same as the groove width, and a plate spring portion B for pressing the surface of the antenna holder 2 when it is mounted onto the groove of the main body case 4.

Although explanation has been given so far for a configuration of the antenna holder wherein the antenna can be held by means of a screw, it is needless to say that other locking methods known to people skilled in the art, such as press fit, can also be adopted.

As heretofore mentioned, according to the invention, an antenna terminal can be mounted onto a main body in the absence of an antenna, and an antenna can be mounted onto the main body case in the absence of the antenna terminal. Therefore, freedom in the assembling process order can be enlarged, and the process can be divided into smaller steps. Furthermore, operativity in assembly can be improved. Since the shape of the antenna holder, the antenna terminal, and the main body case can be simplified, cost can be reduced.

What is claimed is:

1. An antenna holding device comprising:

a main body case;

an antenna having a mounting portion;

an antenna holder mounted to the case for holding the antenna mounting portion;

an antenna terminal held by the main body case;

wherein said antenna and said antenna terminal are independently mounted to the main body case and a groove is provided in the main body case, said antenna terminal includes a bent portion having a size substantially the same as the groove, said groove provided in the main body case for holding the bent portion of the antenna terminal.

2. An antenna holding device according to claim 1, wherein the antenna terminal includes a spring portion for pressing against the antenna holder.

* * * * *